US009726407B2

(12) United States Patent
Oshitani et al.

(10) Patent No.: US 9,726,407 B2
(45) Date of Patent: Aug. 8, 2017

(54) EXPANSION VALVE FOR A REFRIGERATION CYCLE

(71) Applicant: DENSO CORPORATION, Kariya, Aichi-pref. (JP)

(72) Inventors: Hiroshi Oshitani, Toyota (JP); Teruyuki Hotta, Nagoya (JP); Syuichi Mizuno, Nagoya (JP); Ryu Fukushima, Kariya (JP); Shigeji Ohishi, Anjo (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 238 days.

(21) Appl. No.: 14/378,010

(22) PCT Filed: Dec. 5, 2012

(86) PCT No.: PCT/JP2012/007781
§ 371 (c)(1),
(2) Date: Aug. 11, 2014

(87) PCT Pub. No.: WO2013/124936
PCT Pub. Date: Aug. 29, 2013

(65) Prior Publication Data

US 2015/0013368 A1 Jan. 15, 2015

(30) Foreign Application Priority Data

Feb. 20, 2012 (JP) ..... 2012-034068

(51) Int. Cl.
*F25B 41/06* (2006.01)

(52) U.S. Cl.
CPC .... *F25B 41/062* (2013.01); *F25B 2341/0683* (2013.01); *F25B 2500/01* (2013.01)

(58) Field of Classification Search
CPC ..... F25B 41/062; F25B 2341/0682; F25B 2341/0683; G05D 23/02; G05D 23/024; G05D 23/025
See application file for complete search history.

(56) References Cited

U.S. PATENT DOCUMENTS 5,303,864 A * 4/1994 Hirota ..... F25B 41/062 236/92 B
6,540,149 B1 4/2003 Yano et al.
(Continued)

FOREIGN PATENT DOCUMENTS

JP H09159324 A 6/1997
JP 2001033123 A 2/2001
(Continued)

OTHER PUBLICATIONS

D.R. Otis, "An Experimental Thermal Time-Constant Correlation for Hydraulic Accumulators" May 1990, Journal of Dynamic Systems, Measurement, and Control vol. 112/117.*
International Search Report and Written Opinion (in Japanese with English Translation) for PCT/JP2012/007781, mailed Feb. 5, 2013; ISA/JP.
(Continued)

*Primary Examiner* — Etsub Berhanu
*Assistant Examiner* — Nelson Nieves
(74) *Attorney, Agent, or Firm* — Harness, Dickey & Pierce, P.L.C.

(57) ABSTRACT

A temperature sensitive rod is communicated with a diaphragm that is displaceable in response to a pressure difference between an internal pressure of a sealed space, in which a temperature sensitive medium is sealed, and a pressure of a low pressure refrigerant outputted from an evaporator. A blind hole, which opens to the sealed space, is formed in an inside of the temperature sensitive rod. The temperature sensitive medium is a mixture gas of the refrigerant and an inert gas. A mixing ratio of the inert gas in the temperature sensitive medium corresponds to a ratio of an equivalent diameter of the blind hole relative to a depth of the blind hole
(Continued)

in such a manner that a time constant of heat conduction from the temperature sensitive rod to the temperature sensitive medium is kept within a desired time constant range.

3 Claims, 6 Drawing Sheets

(56) References Cited

U.S. PATENT DOCUMENTS

| | | | | |
|---|---|---|---|---|
| 2001/0009099 | A1 | 7/2001 | Kobayashi et al. | |
| 2006/0124758 | A1* | 6/2006 | Sansum | G05D 23/1346 236/12.11 |
| 2007/0283717 | A1* | 12/2007 | Hirota | F25B 41/062 62/527 |
| 2010/0163637 | A1* | 7/2010 | Ikegami | F25B 41/062 236/92 B |
| 2011/0080801 | A1* | 4/2011 | Georg | B01F 3/10 366/337 |
| 2012/0036884 | A1* | 2/2012 | Ahn | F25B 41/062 236/92 B |

FOREIGN PATENT DOCUMENTS

| | | | |
|---|---|---|---|
| JP | 2001201212 | A | 7/2001 |
| JP | 2010031998 | A | 2/2010 |
| JP | 2010133577 | A | 6/2010 |
| JP | 2010230249 | A | 10/2010 |

* cited by examiner

EXPANSION VALVE FOR A REFRIGERATION CYCLE

CROSS REFERENCE TO RELATED APPLICATIONS

This application is a U.S. National Phase Application under 35 U.S.C. 371 of International Application No. PCT/JP2012/007781 filed on Dec. 5, 2012 and published in Japanese as WO 2013/124936 A1 on Aug. 29, 2013. This application is based on Japanese Patent Application No. 2012-034068 filed on Feb. 20, 2012. The entire disclosures of all of the above applications are incorporated herein by reference.

TECHNICAL FIELD

The present disclosure relates to an expansion valve used in a vapor compression refrigeration cycle.

BACKGROUND ART

Previously, there is known an expansion valve, which is applied to a vapor compression refrigeration cycle and depressurizes and expands high pressure refrigerant in such a manner that a degree of superheat of a low pressure refrigerant outputted from an evaporator approaches a predetermined value. This type of expansion valve includes an element portion, which is displaced in response to a temperature and a pressure of the low pressure refrigerant outputted from the evaporator, and a valve element is displaced by the element portion to adjust an opening degree of a throttle passage, which depressurizes and expands the high pressure refrigerant.

More specifically, the element portion includes a diaphragm (a pressure-operated member), which is displaced in response to a pressure difference between an internal pressure of a sealed space and a pressure of the low pressure refrigerant outputted from the evaporator. Here, the sealed space is a space, in which a temperature sensitive medium that changes a pressure thereof in response to a temperature is sealed. The displacement of the diaphragm is conducted to the valve element through a temperature sensitive rod, which conducts the temperature of the low pressure refrigerant outputted from the evaporator.

In this way, the pressure of the temperature sensitive medium in the sealed space is adjusted to the pressure, which corresponds to the temperature of the low pressure refrigerant outputted from the evaporator, and the diaphragm is displaced by the pressure difference between the internal pressure of the sealed space and the pressure of the low pressure refrigerant outputted from the evaporator. Specifically, the diaphragm is displaced in response to the temperature and the pressure of the low pressure refrigerant outputted from the evaporator, and thereby the valve element is displaced to adjust an opening degree of the throttle passage.

In this type of expansion valve, for example, when a response time period (a time constant), which is a time period required to adjust the pressure and the temperature of the temperature sensitive medium into an equilibrium state through the heat conduction from the temperature sensitive rod, is reduced in comparison to a response time period of the other functional component(s) or a response time period of the refrigeration cycle, a phenomenon known as a hunting phenomenon occurs to cause instability of the refrigeration cycle.

In order to address this issue, in a prior art expansion valve, a blind hole is formed in the temperature sensitive rod to extend in an inside of the temperature sensitive rod in an axial direction and to open to the sealed space, and activated carbon is sealed in the inside of the blind hole, or a low heat conductivity layer, which has a lower heat conductivity in comparison to the temperature sensitive rod, is provided to an inner wall of the blind hole (see, for example, the Patent Literature 1). In this way, the required time constant of the heat conduction from the temperature sensitive rod to the temperature sensitive medium is ensured to limit the hunting phenomenon.

CITATION LIST

Patent Literature

PATENT LITERATURE 1: JP2010-133577A (corresponding to US2010/0163637A1)

SUMMARY OF THE INVENTION

However, like in the prior art technique, when the activated carbon is sealed in the inside of the blind hole of the temperature sensitive rod, or the low heat conductivity layer is provided to the inner wall of the blind hole, the internal structure of the temperature sensitive rod becomes complicated to cause an increase in the number of manufacturing steps and an increase in the manufacturing costs, thereby disadvantageously resulting in a deterioration in the productivity of the expansion valve.

The present disclosure is made in view of the above disadvantages, and it is an objective of the present disclosure to provide an expansion valve that can limit an unstable operation of a refrigeration cycle with a simple structure.

In order to achieve the above objective, the inventors of the present application have considered the following points. First of all, the inventors of the present application have focused on the following phenomenon. That is, when a mixture gas, which is a mixture of a refrigerant and an inert gas, is used as the temperature sensitive medium, a diffusion state of the heat from the temperature sensitive rod to the temperature sensitive medium (a pressure diffusion state of the temperature sensitive medium) is changed, and thereby the response time period (the time constant), which is the time period required to change the temperature and the pressure of the temperature sensitive medium into the equilibrium state, is changed. In view of the above phenomenon, the inventors of the present application have studied adjustment of the time constant of the heat conduction from the temperature sensitive rod to the temperature sensitive medium by changing a mixing ratio of the inert gas in the temperature sensitive medium.

According to the study of the inventors of the present application, it is found that when the mixing ratio of the inert gas is increased, the diffusion of the heat from the temperature sensitive rod to the temperature sensitive medium is delayed, and the time constant of the heat conduction from the temperature sensitive rod to the temperature sensitive medium is lengthened.

However, in reality, when the mixing ratio of the inert gas is adjusted alone, it is difficult to adjust the time constant of the heat conduction from the temperature sensitive rod to the temperature sensitive medium within a desired time constant range in some cases.

Then, the inventors of the present application have studied the cause, which makes it difficult to adjust the time constant of the heat conduction from the temperature sensitive rod to the temperature sensitive medium. Through this study, it is found that the diffusion state of the heat from the temperature sensitive rod to the temperature sensitive medium varies depending on a shape of the blind hole formed in the inside of the temperature sensitive rod. Specifically, when a ratio of an equivalent diameter of the blind hole, which is measured in a direction perpendicular to an axial direction of the temperature sensitive rod, relative to a depth of the blind hole, is increased, the diffusion of the heat from the temperature sensitive rod to the temperature sensitive medium is delayed, and thereby the time constant of the heat conduction from the temperature sensitive rod to the temperature sensitive medium is lengthened.

The present disclosure is made based on the finding of that there is a close relationship among the time constant of the heat conduction from the temperature sensitive rod to the temperature sensitive medium, the shape of the blind hole in the inside of the temperature sensitive rod, and the mixing ratio of the inert gas in the temperature sensitive medium.

Specifically, the expansion valve of the present disclosure includes:

a body portion that forms:

a high pressure refrigerant passage that conducts a high pressure refrigerant;

a throttle passage that is provided in the high pressure refrigerant passage, wherein the throttle passage depressurizes and expands the high pressure refrigerant; and a low pressure refrigerant passage that conducts a low pressure refrigerant, which is outputted from the evaporator;

a valve element that adjusts an opening degree of the throttle passage;

an element portion that is placed outside of the body portion and includes a pressure-operated member, wherein the pressure-operated member is displaceable in response to a pressure difference between:

an internal pressure of a sealed space of the element portion, in which a temperature sensitive medium is sealed, wherein a pressure of the temperature sensitive medium is changeable in response to a temperature; and a pressure of the low pressure refrigerant that flows in the low pressure refrigerant passage; and a temperature sensitive rod that is placed such that at least a portion of the temperature sensitive rod is located in the low pressure refrigerant passage, wherein the temperature sensitive rod conducts displacement of the pressure-operated member to the valve element and conducts a temperature of the low pressure refrigerant, which flows through the low pressure refrigerant passage, to the temperature sensitive medium.

According to the present disclosure, the temperature sensitive rod includes a blind hole, which opens to the sealed space and extends in an inside of the temperature sensitive rod in an axial direction of the temperature sensitive rod; the temperature sensitive medium is a mixture gas, which is a mixture of a refrigerant and an inert gas, wherein the inert gas is different from the refrigerant; and a mixing ratio of the inert gas in the temperature sensitive medium is set based on a ratio of an equivalent diameter of the blind hole, which is measured in a direction perpendicular to the axial direction of the temperature sensitive rod, relative to a depth of the blind hole, which is measured in the axial direction of the temperature sensitive rod, in such a manner that a time constant of heat conduction from the temperature sensitive rod to the temperature sensitive medium is kept within a predetermined time constant range.

In this way, the required time constant of the heat conduction from the temperature sensitive rod to the temperature sensitive medium can be appropriately ensured by setting the mixing ratio of the inert gas according to the ratio of the equivalent diameter of the blind hole relative to the depth of the blind hole without a need for sealing the activated carbon in the blind hole of the temperature sensitive rod or providing the low heat conductivity layer or the like in the blind hole of the temperature sensitive rod.

Thus, it is possible to implement the expansion valve, which can limit the unstable operation of the refrigeration cycle with the simple structure. Here, the equivalent diameter is meant to be a diameter of a circle that corresponds to a cross-sectional area of the blind hole even in a case where the cross-sectional area of the blind hole is not the circle (e.g., a case of an ellipse shape, a polygonal shape).

DESCRIPTION OF EMBODIMENTS

Figure 1:
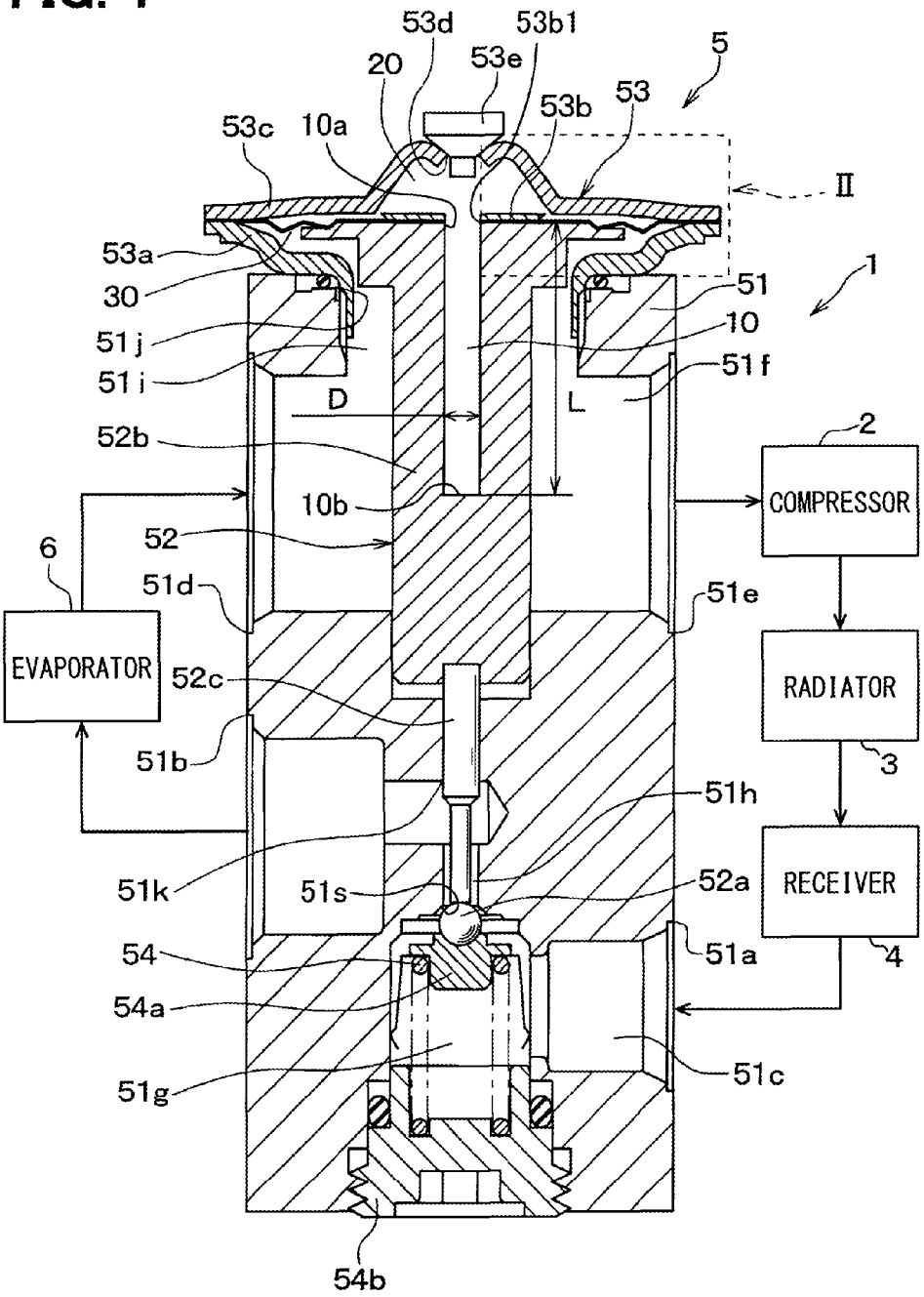
FIG. 1 is a cross-sectional view of an expansion valve according to a first embodiment of the present disclosure.

Various embodiments of the present disclosure will be described with reference to the accompanying drawings. In each of the following embodiments, the same or similar components are indicated by the same reference numerals in the drawing(s).

(First Embodiment)

A first embodiment of the present disclosure will be described. As shown in FIG. 1, an expansion valve 5 of the present embodiment is applied to a vapor compression refrigeration cycle 1 (hereinafter simply referred to as a refrigeration cycle 1) of a vehicle air conditioning system. In FIG. 1, a connection relationship between the expansion valve 5 and the respective constituent devices of the refrigeration cycle 1 is also schematically indicated.

The refrigeration cycle 1 of the present embodiment uses a chlorofluorocarbon refrigerant (R134a) as the refrigerant and forms a subcritical cycle, in which a pressure of the high pressure refrigerant does not exceed a critical pressure of the refrigerant.

A compressor 2 of the refrigeration cycle 1 receives a drive force of an undepicted vehicle drive engine through, for example, an electromagnetic clutch, to draw and compress the refrigerant. Alternatively, the compressor 2 may be an electric compressor, which is driven by a drive force outputted from an undepicted electric motor.

A radiator 3 is a heat radiating heat exchanger that releases the heat from the high pressure refrigerant by exchanging the heat between the high pressure refrigerant, which is discharged from the compressor 2, and an external air (an external air at outside of a cabin of the vehicle), which is blown by an undepicted cooling fan, to condense the refrigerant.

An outlet of the radiator 3 is connected to a liquid receiver (receiver) 4, which separates the high pressure refrigerant outputted from the radiator 3 into a gas phase refrigerant and a liquid phase refrigerant and accumulates the excessive liquid phase refrigerant of the cycle. Furthermore, a liquid phase refrigerant outlet of the receiver 4 is connected to the expansion valve 5.

The expansion valve 5 depressurizes and expands the high pressure refrigerant, which is outputted from the receiver 4. Also, the expansion valve 5 changes a passage cross-sectional area (a valve opening degree) of a throttle passage in response to a temperature and a pressure of the low pressure refrigerant, which is outputted from the evaporator 6, in such a manner that a degree of superheat of the low pressure refrigerant, which is outputted from the evaporator 6, approaches a predetermined value. In this way, a quantity of the refrigerant, which is outputted to a refrigerant inlet of the evaporator 6, is adjusted. The details of the expansion valve 5 will be described later.

The evaporator 6 is a heat absorbing heat exchanger that exchanges the heat between the low pressure refrigerant, which is depressurized and expanded through the expansion valve 5, and the air, which is blown by an undepicted blower, so that the low pressure refrigerant is evaporated to absorb the heat. Furthermore, the outlet of the evaporator 6 is connected to an intake side of the compressor 2 through a low pressure refrigerant passage 51*f*, which is formed in an inside of the expansion valve 5.

Next, the structure of the expansion valve 5 will be described in detail. The expansion valve 5 is of an internal pressure equalizing type and includes a body portion 51, a valve portion 52 and an element portion 53, as shown in FIG. 1.

The body portion 51 forms, for example, an outer shell of the expansion valve 5 and refrigerant passages in the inside of the expansion valve 5. The body portion 51 is formed by applying a hole forming process to a metal block, which is configured into a cylindrical tubular form or a polygonal tubular form. Refrigerant inlets and outlets 51*a*, 51*b*, 51*d*, 51*e*, a valve chamber 51*g*, a throttle passage 51*h*, a communication chamber 51*i*, and an installation hole 51*j* are formed in the body portion 51.

A first flow inlet 51*a*, which is connected to the liquid phase refrigerant outlet of the receiver 4 to receive the high pressure liquid phase refrigerant, and a first flow outlet 51*b*, which outputs the refrigerant received from the first flow inlet 51*a* to the inlet of the evaporator 6, are formed as the refrigerant flow inlet and the refrigerant flow outlet, respectively. Therefore, in the present embodiment, the refrigerant passage, which extends from the first flow inlet 51*a* to the first flow outlet 51*b*, forms a high pressure refrigerant passage 51*c*.

Furthermore, a second flow inlet 51*d*, which receives the low pressure refrigerant outputted from the evaporator 6, and a second flow outlet 51*e*, which outputs the refrigerant received from the second flow inlet 51*d* to the intake side of the compressor 2, are formed as the other refrigerant flow inlet and the other refrigerant flow outlet, respectively. Therefore, in the present embodiment, the refrigerant passage, which extends from the second flow inlet 51*d* to the second flow outlet 51*e*, forms the low pressure refrigerant passage 51*f*.

The valve chamber 51*g* is a space that is formed in the high pressure refrigerant passage 51*c* and receives a spherical valve 52*a* of the valve portion 52 discussed later. Specifically, the valve chamber 51*g* is directly communicated with the first flow inlet 51*a* and is communicated with the first flow outlet 51*b* through the throttle passage 51*h*. The throttle passage 51*h* is formed in the high pressure refrigerant passage 51*c*. The throttle passage 51*h* is a passage that conducts the refrigerant, which is supplied to the valve chamber 51*g* through the first flow inlet 51*a*, from the valve chamber 51*g* to the first flow outlet 51*b* while depressurizing and expanding the refrigerant.

The communication chamber 51*i* is a space that is formed to communicate with the low pressure refrigerant passage 51*f* and the installation hole 51*j* formed in a top surface of the body portion 51. The element portion 53, which will be described later, is installed into the installation hole 51*j* from the outside of the body portion 51.

The valve portion 52 includes: the spherical valve 52*a*, which is a valve element formed in one end part of the valve portion 52; a temperature sensitive rod 52*b*, which is configured into a generally cylindrical tube form and is joined to a diaphragm 53*b* of the element portion 53 by joining means, such as welding, bonding; and an actuation rod 52*c*, which is configured into a generally cylindrical tubular form and is coaxially joined to the temperature sensitive rod 52*b* by means, such as press fitting, and contacts the spherical valve 52*a*.

The spherical valve 52*a* is the valve element, which is displaceable in an axial direction of the temperature sensitive rod 52*b* and the actuation rod 52*c* to adjust a refrigerant passage cross-sectional area of the throttle passage 51*h*. A coil spring 54 is received in the valve chamber 51*g*. The coil spring 54 exerts a load through a support member 54*a* to urge the spherical valve 52*a* in a valve closing direction that is a direction for closing the throttle passage 51*h* with the spherical valve 52*a*. That is, the coil spring 54 exerts the load, which urges the spherical valve 52*a* against a valve seat 51*s* formed in a valve chamber 51*g* side opening of the throttle passage 51*h*. Furthermore, the load, which is exerted by the coil spring 54, is adjustable with an adjusting screw 54*b*.

The temperature sensitive rod 52*b* is arranged such that the temperature sensitive rod 52*b* extends through the communication chamber 51*i* and the installation hole 51*j*, and at least a portion of an outer peripheral surface of the temperature sensitive rod 52*b* is exposed to the low pressure refrigerant, which flows in the low pressure refrigerant passage 51*f*. In this way, the temperature sensitive rod 52*b* can conduct the temperature of the low pressure refrigerant, which is outputted from the evaporator 6 and flows in the low pressure refrigerant passage 51*f*, to the element portion 53. The temperature sensitive rod 52*b* is desirably made of a material, which has high heat conductivity and high strength. In the present embodiment, the temperature sensitive rod 52*b* is made of stainless steel.

Furthermore, a blind hole (also referred to as a tubular space configured into a recess form) 10 is directly formed in the inside of the temperature sensitive rod 52*b* such that the blind hole 10 extends in the axial direction of the temperature sensitive rod 52*b* and is opened at an opening 10*a* thereof relative to a sealed space 20 described later. The blind hole 10 of the present embodiment is opened at the opening 10*a* in one axial end side (the sealed space 20 side)

of the blind hole 10 and is closed with a bottom surface 10*b* in the other axial end side of the blind hole 10. In this way, the temperature sensitive rod 52*b* forms a vessel, which is configured into a tubular form having a bottom. In view of the conduction of the temperature of the low pressure refrigerant, which flows in the low pressure refrigerant passage 51*f*, a wall thickness of the temperature sensitive rod 52*b*, which is measured between an inner peripheral side and an outer peripheral side of the temperature sensitive rod 52*b*, is desirably equal to or less than 5 mm.

The blind hole 10 of the present embodiment is formed such that the blind hole 10 overlaps with the low pressure refrigerant passage 51*f* in a direction perpendicular to the axial direction of the temperature sensitive rod 52*b*. In this way, the temperature (the heat) of the low pressure refrigerant, which is outputted from the evaporator 6, can be conducted to a temperature sensitive medium in the inside of the blind hole 10, in which the external air temperature has the less influence in comparison to the sealed space 20.

Specifically, here, a range, which extends form a lower surface of the low pressure refrigerant passage 51*f* to the installation hole 51*j* of the body portion 51 in the axial direction of the temperature sensitive rod 52*b*, is referred to as a low pressure refrigerant flow range. In such a case, a depth L (unit: mm) of the blind hole 10 in the axial direction of the temperature sensitive rod 52*b* is set in such a manner that a position of the bottom surface 10*b* of the blind hole 10 is located within the low pressure refrigerant flow passage range. Here, it is desirable to set the depth L of the blind hole 10 such that in the low pressure refrigerant flow passage range, the bottom surface 10*b* of the blind hole 10 is placed on a side of the installation hole 51*j* of the body portion 51 where the lower surface of the low pressure refrigerant passage 51*f* is located.

Furthermore, because of the processing limitations, the blind hole 10 is desirably configured into a shape, which results in that a ratio $\alpha$ of an equivalent diameter D (unit: mm) of the blind hole 10, which is measured in a direction perpendicular to the axial direction of the temperature sensitive rod 52*b*, relative to the depth L of the blind hole 10 measured in the axial direction of the temperature sensitive rod 52*b*, is equal to or less than 10. In the present embodiment, the blind hole 10 is configured such that the ratio $\alpha$ of the equivalent diameter D (unit: mm) of the blind hole 10 relative to the depth L of the blind hole 10 is in a range of $0<\alpha<10$.

The actuation rod 52*c* is arranged such that the actuation rod 52*c* is received through a valve portion receiving hole 51*k* and the throttle passage 51*h*, which are formed to extend through the body portion 51 between the communication chamber 51*i* and the valve chamber 51*g*. A gap between the valve portion receiving hole 51*k* and the actuation rod 52*c* of the valve portion 52 is sealed by a seal member, such as an undepicted O-ring. Therefore, even when the valve portion 52 is displaced, the refrigerant will not leak through the gap between the valve portion receiving hole 51*k* and the valve portion 52.

The element portion 53 includes: an element housing 53*a*, which is installed to the installation hole 51*j* by fixing means, such as screw; a diaphragm 53*b*, which is a pressure-operated member; and an element cover 53*c*, which clamps an outer peripheral edge part of the diaphragm 53*b* in cooperation with the element housing 53*a* and forms an outer shell of the element portion 53.

The element housing 53*a* and the element cover 53*c* are made of metal such as stainless steel (SUS304) and are configured into a cup form. In a state where the element housing 53*a* and the element cover 53*c* clamp the outer peripheral edge part of the diaphragm 53*b* therebetween, a radially outer end part of the element housing 53*a* and a radially outer end part of the element cover 53*c* are joined together by joining means, such as welding, brazing. Therefore, an internal space of the element portion 53, which is formed by the element housing 53*a* and the element cover 53*c*, is divided into two spaces by the diaphragm 53*b*.

One of these two spaces, which is formed by the element cover 53*c* and the diaphragm 53*b*, is the sealed space 20, in which the temperature sensitive medium that changes the pressure thereof in response to the temperature of the low pressure refrigerant outputted from the evaporator 6, is sealed. The sealed space 20 is communicated with the interior space of the blind hole 10, which is formed in the inside of the temperature sensitive rod 52*b*, through a through-hole 53*b*1 that is formed in a center part of the diaphragm 53*b* and extends between a front and a back of the diaphragm 53*b*.

In contrast, the other space, which is formed by the element housing 53*a* and the diaphragm 53*b*, is an introducing space 30, which is communicated with the communication chamber 51*i* to receive the low pressure refrigerant outputted from the evaporator 6. Thus, the temperature sensitive medium, which is sealed in the blind hole 10 and the sealed space 20, receives the temperature of the low pressure refrigerant, which is outputted from the evaporator 6 and flows in the low pressure refrigerant passage 51*f*, through the temperature sensitive rod 52*b*, and also receives the temperature of the low pressure refrigerant, which is outputted from the evaporator 6 and is introduced into the introducing space 30, through the diaphragm 53*b*.

Thus, the internal pressure of the blind hole 10 and the sealed space 20 becomes a pressure, which corresponds to the temperature of the low pressure refrigerant outputted from the evaporator 6. The diaphragm 53*b* is displaceable in response to a differential pressure between the internal pressure of the blind hole 10 and the sealed space 20 and the pressure of the low pressure refrigerant, which is outputted from the evaporator 6 and is introduced into the introducing space 30.

Figure 2:
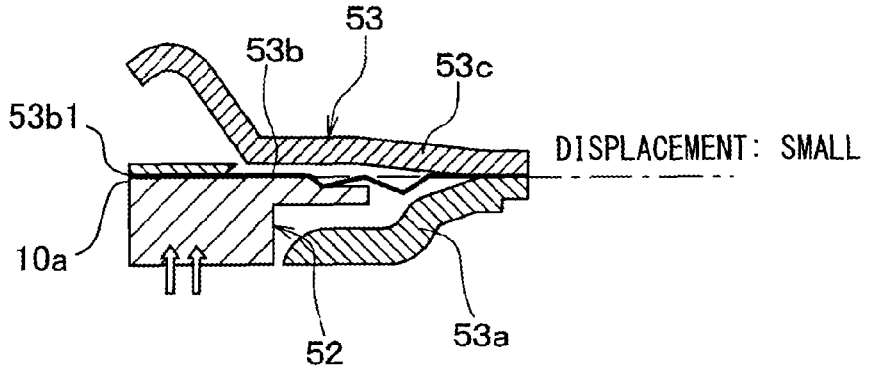
FIG. 2(*a*) and FIG. 2(*b*) are partially enlarged views of an area indicated by an arrow II in FIG. 1 for describing displacement of a diaphragm according to the first embodiment.
Figure 2:
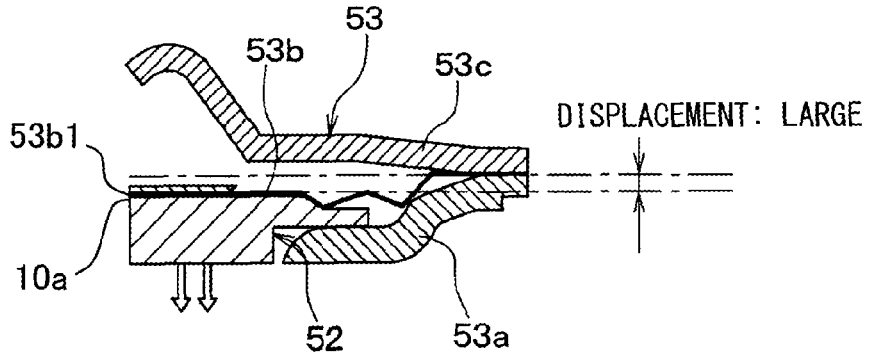

For example, as shown in FIG. 2(*a*), the diaphragm 53*b* is upwardly displaced in response to a decrease in the internal pressure of the blind hole 10 and the sealed space 20. Furthermore, as shown in FIG. 2(*b*), the diaphragm 53*b* is downwardly displaced in response to an increase in the internal pressure of the blind hole 10 and the sealed space 20. FIGS. 2(*a*) and 2(*b*) are partially enlarged views of a portion indicated by an arrow II in FIG. 1.

Thus, it is desirable to form the diaphragm 53*b* from the material, which has the high resiliency, the high heat conductivity and the high strength. For example, the diaphragm 53*b* is made of a metal thin plate of, for instance, stainless steel (SUS 304).

Furthermore, as shown in FIG. 1, a filling hole 53*d* is formed in the element cover 53*c* to fill the temperature sensitive medium into the sealed space 20. A distal end part of the filling hole 53*d* is closed by a sealing plug 53*e* after filling of the temperature sensitive medium into the sealed space 20 through the filling hole 53*d*.

Furthermore, a mixture gas, which is a mixture of the refrigerant in a gas phase and an inert gas, is filled into the sealed space 20 of the present embodiment as the temperature sensitive medium.

In the present embodiment, the refrigerant, which is sealed into the sealed space 20, is the refrigerant that has the same composition as that of the refrigerant circulated in the refrigeration cycle 1, and the inert gas is, for example, helium or nitrogen, which shows the temperature-pressure characteristic that is similar to the temperature-pressure characteristic of the ideal gas in an operating temperature range (e.g., −30 to 60 degrees Celsius) of the expansion valve 5.

Figure 3:
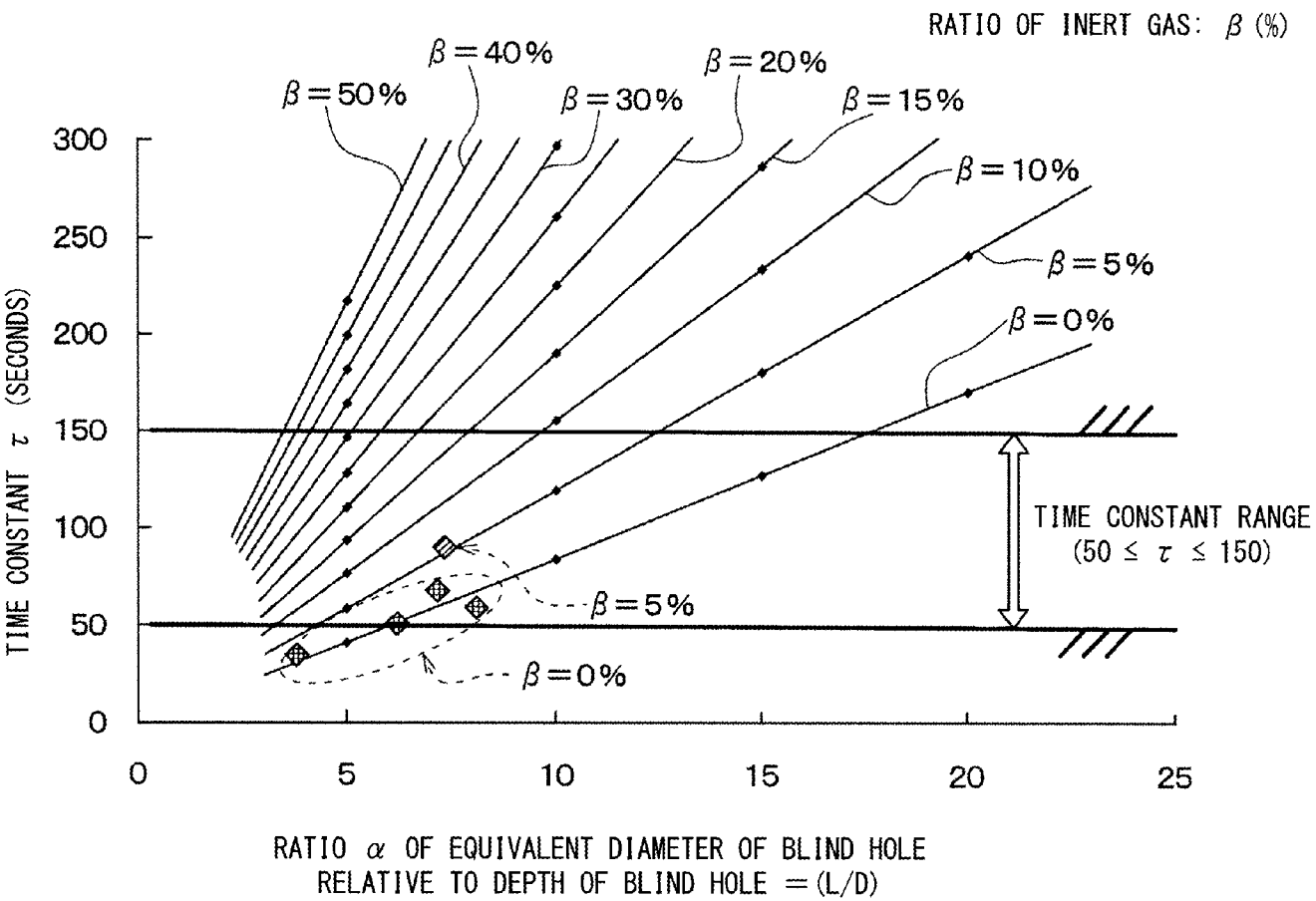
FIG. 3 is a characteristic diagram showing an example of a change in a time constant of heat conduction to a temperature sensitive medium relative to a change in a ratio of an equivalent diameter of a blind hole relative to a depth of the blind hole, and a change in a mixing ratio of an inert gas.

In the present embodiment, a mixing ratio β of the inert gas in the temperature sensitive medium is set according to the shape of the blind hole 10 in such a manner that a time constant τ (unit: seconds) of the heat conduction from the temperature sensitive rod 52*b* to the temperature sensitive medium is kept within a desired time constant range (a predetermined time constant range). The mixing ratio β of the inert gas will be described with reference to the characteristic diagrams shown in FIGS. 3 and 4. FIG. 3 is the characteristic diagram showing a change in the time constant τ of the heat conduction to the temperature sensitive medium relative to a change in the ratio α (=L/d) of the equivalent diameter D of the blind hole 10 relative to the depth L of the blind hole 10, and a change in the mixing ratio β (%) of the inert gas. Plots shown in the drawing are actual measured values at 0% and 5% of the mixing ratio β of the inert gas. Furthermore, lines of the respective mixing ratios β of the inert gas shown in the drawing are based on the simulation result.

As shown in FIG. 3, the time constant τ tends to be lengthened in proportional to an increase in the ratio α of the equivalent diameter D of the blind hole 10 relative to the depth L of the blind hole 10. Furthermore, a change rate (a gradient) of the time constant τ relative to the ratio α of the equivalent diameter D relative to the depth L tends to be increased in response to an increase in the mixing ratio β of the inert gas. In a case of achieving the predetermined time constant τ, a relationship (inverse proportion) exists such that the mixing ratio β of the inert gas is increased when the ratio α of the equivalent diameter D of the blind hole 10 relative to the depth L of the blind hole 10 is decreased.

This relationship among α, β, and τ can be approximated with the following equations F1, F2.

$$\tau = K \times \alpha \quad \text{(F1)}$$

$$K = 70 \times \beta + 0.85 \quad \text{(F2)}$$

In the equation F2, β is an absolute value and is not the percent.

In the present embodiment, when the time constant τ and the ratio α of the equivalent diameter D of the blind hole 10 relative to the depth L of the blind hole 10 are set, the inert gas is sealed into the sealed space 20 in a manner that satisfies the equations F1, F2.

Here, when the time constant τ of the heat conduction from the temperature sensitive rod 52*b* to the temperature sensitive medium is reduced in comparison to the time constant of, for example, the refrigeration cycle 1, the phenomenon known as the hunting phenomenon occurs to cause instability of the refrigeration cycle 1. In contrast, when the time constant τ becomes too long, the readiness of the expansion valve 5 relative to the operation of the other functional component(s) and the operation of the refrigeration cycle 1 is deteriorated.

Therefore, in the present embodiment, the mixing ratio β of the inert gas is set in such a manner that the time constant τ is kept within a range that is equal to or longer than 50 seconds and is equal to or shorter than 150 seconds. Here, the lower limit value (=50 seconds) of the time constant τ is a set value for limiting the hunting phenomenon, and the upper limit value (=150 seconds) of the time constant τ is a set value for ensuring the readiness of the expansion valve 5.

Thus, in the present embodiment, the mixing ratio β of the inert gas is set to be a value, which satisfies the equations F1, F2 in a case where the time constant range of the time constant τ is 50 seconds≤τ≤150 seconds, and the ratio α of the equivalent diameter D of the blind hole 10 relative to the depth L of the blind hole 10 is 0<α<10.

When the differential pressure is generated between the internal pressure of the blind hole 10 and the sealed space 20 and the pressure of the low pressure refrigerant, which is outputted from the evaporator 6 and is supplied into the introducing space 30, the diaphragm 53*b* is displaced, as shown in FIGS. 2(*a*) and 2(*b*). At this time, an internal volume of the sealed space 20, in which the temperature sensitive medium is sealed, is also changed.

Specifically, when the amount of upward displacement of the diaphragm 53*b* becomes a maximum value, the internal volume of the sealed space 20, in which the temperature sensitive medium is sealed, is reduced and becomes a minimum volume. When the amount of downward displacement of the diaphragm 53*b* becomes a minimum value, the internal volume of the sealed space 20, in which the temperature sensitive medium is sealed, is increased and becomes a maximum volume.

The inert gas, which is the constituent component of the temperature sensitive medium, exhibits the characteristic (the relationship of the inverse proportion between the volume and the pressure), which is similar to that of the ideal gas. Therefore, when the internal volume of the sealed space 20 is changed, the change in the partial pressure of the inert gas is generated to cause the change in the amount of displacement of the diaphragm 53*b*. This change in the partial pressure of the temperature sensitive medium has the influence on the temperature sensing performance for sensing the temperature of the low pressure refrigerant, which is outputted from the evaporator 6 and is received in the temperature sensitive rod 52*b*. Therefore, it is desirable to reduce the change in the partial pressure of the temperature sensitive medium as much as possible.

Figure 4:
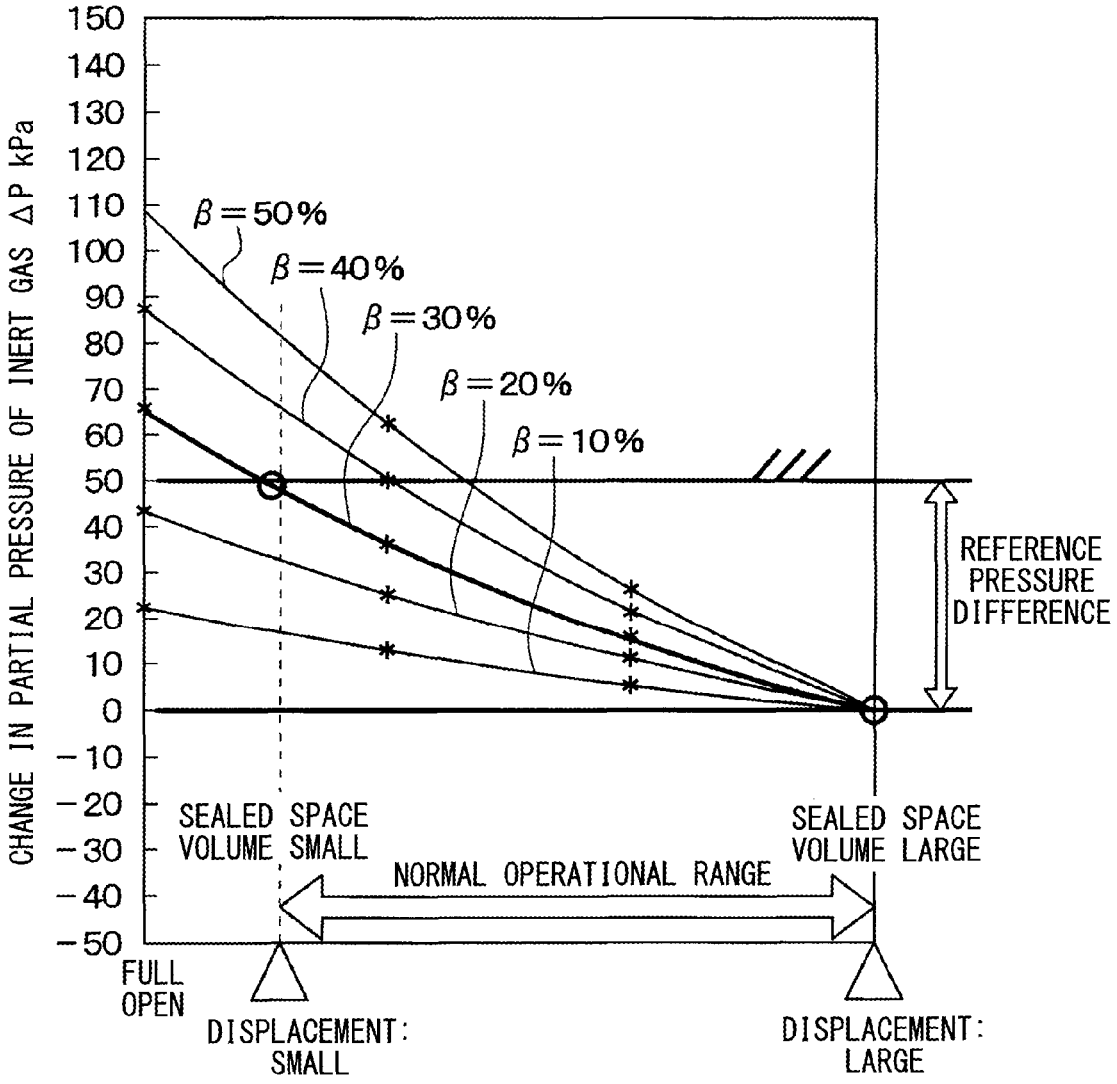
FIG. 4 is a characteristic diagram showing a change in a partial pressure of the inert gas in response to a change in a volume in an inside of an element portion.

FIG. 4 is a characteristic diagram showing the change in the partial pressure of the inert gas caused by a change in the volume of the sealed space 20 located in the inside of the element portion 53. As shown in FIG. 4, according to the experiment of the inventors of the present application, it is found that when the mixing ratio β of the inert gas is increased, the change in the partial pressure of the inert gas caused by the change in the internal volume of the sealed space 20 is increased.

Therefore, in the present embodiment, the mixing ratio β of the inert gas is set in such a manner that a differential pressure (a change in the partial pressure) between the partial pressure of the inert gas at the time of decreasing of the internal volume of the sealed space 20 caused by the displacement of the diaphragm 53*b* and the partial pressure ΔP of the inert gas at the time of increasing of the internal volume of the sealed space 20 caused by the displacement of the diaphragm 53*b* is kept in a range that is equal to or less than a predetermined reference pressure difference.

Specifically, in the present embodiment, as shown in FIG. 4, the inert gas is sealed into the sealed space 20 in such a manner that a change in the partial pressure of the inert gas is kept in a range (a range of 0% to 30% in the present embodiment), which is equal to or smaller than 50 kPa (a temperature difference of the temperature sensitive medium being 5 degrees Celsius) in a normal operational range upon occurrence of the change in the internal volume of the sealed space 20.

In a case where the mixing ratio β of the inert gas, which satisfies the equations F1, F2, exceeds the range, which is equal to or lower than the reference pressure difference, the upper limit value (30% in the present embodiment) in the range, which is equal to or lower than the reference pressure difference, may be set as the mixing ratio β of the inert gas in order to limit the increase in the partial pressure of the inert gas.

Next, an operation of the present embodiment with the above-described structure will be described. When the compressor 2 is rotated by the drive force of the vehicle engine, the high temperature and high pressure refrigerant, which is outputted from the compressor 2, enters the radiator 3 where the high temperature and high pressure refrigerant exchanges the heat with the external air blown from the cooling fan and is thereby condensed upon releasing the heat. The refrigerant, which is outputted from the radiator 3, enters the receiver 4 where the refrigerant is separated into the liquid-phase refrigerant and the gas-phase refrigerant.

The high pressure liquid phase refrigerant, which is outputted from the receiver 4, is supplied to the valve chamber 51*g* through the first flow inlet 51*a* of the expansion valve 5 and flows to the throttle passage 51*h* where the high pressure liquid phase refrigerant is depressurized and is expanded. At this time, the refrigerant passage cross-sectional area of the throttle passage 51*h* is adjusted in such a manner that the degree of superheat of the low pressure refrigerant, which is outputted from the evaporator 6, approaches the predetermined value, as discussed later.

The low pressure refrigerant, which is depressurized and is expanded at the throttle passage 51*h*, is outputted through the first flow outlet 51*b* and is supplied to the evaporator 61. The refrigerant, which is supplied to the evaporator 6, evaporates upon absorbing the heat from the air, which is blown by the blower. Furthermore, the refrigerant, which is outputted from the evaporator 6, is supplied to the expansion valve 5 through the second flow inlet 51*d*.

Here, when the degree of superheat of the low pressure refrigerant, which is outputted from the evaporator 6 and is supplied to the communication chamber 51*i* through the second flow inlet 51*d*, is increased, the pressure of the temperature sensitive medium, which is sealed into the blind hole 10 and the sealed space 20, is increased. Therefore, the differential pressure, which is obtained by subtracting the pressure of the introducing space 30 from the internal pressure of the blind hole 10 and the sealed space 20, is increased. In this way, the diaphragm 53*b* is displaced in a direction, which is a valve opening direction of the valve portion 52 for opening the throttle passage 51*h* (see FIG. 2(*b*)). Specifically, as shown in FIG. 2(*b*), the diaphragm 53*b* is displaced in the direction away from the element cover 53*c* (the downward axial direction in FIG. 2(*b*)), so that the valve portion 52 is displaced in the direction away from the element cover 53*c*. In this way, the valve portion 52 urges the spherical valve 52*a* against the urging force of the coil spring 54 to lift the spherical valve 52*a* away from the valve seat 51*s*, so that the throttle passage 51*h* is opened.

In contrast, when the degree of superheat of the low pressure refrigerant, which is outputted from the evaporator 6, is decreased, the pressure of the temperature sensitive medium, which is sealed into the sealed space 20, is decreased, and thereby the differential pressure, which is obtained by subtracting the pressure of the introducing space 30 from the internal pressure of the blind hole 10 and the sealed space 20, is decreased. In this way, the diaphragm 53*b* is displaced in a direction, which is a valve closing direction of the valve portion 52 for closing the throttle passage 51*h* (see FIG. 2(*a*)). Specifically, as shown in FIG. 2(*a*), the diaphragm 53*b* is displaced toward the element cover 53*c* (the upward axial direction in FIG. 2(*a*)), so that the valve portion 52 is displaced toward the element cover 53*c*, and the spherical valve 52*a* is seated against the valve seat 51*s* by the urging force of the coil spring 54. Thus, the throttle passage 51*h* is closed.

As discussed above, the element portion 53 (specifically, the diaphragm 53*b*) displaces the valve portion 52 in response to the degree of superheat of the low pressure refrigerant, which is outputted from the evaporator 6, so that the passage cross sectional area of the throttle passage 51*h* is adjusted in such a manner that the degree of superheat of the low pressure refrigerant, which is outputted from the evaporator 6, approaches the predetermined value. The value of the predetermined degree of superheat can be changed by changing the valve opening pressure of the valve portion 52 through adjustment of the load, which is applied from the coil spring 54 to the valve portion 52, by using the adjusting screw 54*b*.

The refrigerant, which is outputted from the second flow outlet 51*e*, is drawn into the compressor 2 and is compressed once again. The air, which is blown by the blower, is cooled by the evaporator 6 and is then temperature adjusted to a target temperature by an undepicted heating means (e.g., a hot water heater core), which is placed on a downstream side of the evaporator 6 in the flow direction of the air, and this temperature adjusted air is blown into a cabin of the vehicle, which is an air conditioning subject space.

In the expansion valve 5 of the present embodiment discussed above, the mixing ratio β of the inert gas is set according to the ratio α ($0<\alpha<10$) of the equivalent diameter D of the blind hole 10 relative to the depth L of the blind hole 10 in such a manner that the time constant τ of the heat conduction from the temperature sensitive rod 52*b* to the temperature sensitive medium is kept within the predetermined time constant range ($50\leq\tau\leq150$).

In this way, the required time constant τ of the heat conduction from the temperature sensitive rod 52*b* to the temperature sensitive medium can be appropriately ensured by setting the mixing ratio β of the inert gas according to the ratio α of the equivalent diameter D of the blind hole 10 relative to the depth L of the blind hole 10 without a need for sealing the activated carbon in the blind hole 10 of the temperature sensitive rod 52*b* or providing the low heat conductivity layer or the like in the blind hole 10 of the temperature sensitive rod 52*b*. Thus, it is possible to implement the expansion valve 5, which can limit the unstable operation of the refrigeration cycle 1 with the simple structure.

Particularly, in the present embodiment, the inert gas is sealed into the sealed space 20 in such a manner that the mixing ratio β of the inert gas satisfies the relationship indicated by the equations F1, F2 when the time constant τ, which is kept within the predetermined time constant range, and the ratio α of the equivalent diameter D of the blind hole 10 relative to the depth L of the blind hole 10, are set. Thus, the time constant τ of the heat conduction from the temperature sensitive rod 52*b* to the temperature sensitive medium in the blind hole 10 can be appropriately adjusted within the desired time constant range by changing the mixing ratio β of the inert gas according to the ratio α of the equivalent diameter D of the blind hole 10 relative to the depth L of the blind hole 10.

Furthermore, in the present embodiment, the range of the time constant τ is set to be equal to or longer than 50 seconds and is equal to or shorter than 150 seconds. Thereby, the hunting phenomenon in the expansion valve 5 can be limited, and the readiness of the expansion valve 5 can be ensured.

Furthermore, in the present embodiment, the inert gas is sealed into the sealed space 20 in such a manner that the change in the partial pressure of the inert gas, which is generated at the time of changing the internal volume of the sealed space 20 in response to the displacement of the diaphragm 53*b*, is kept in the range, which is equal to or less than the predetermined reference pressure difference. In this way, the change in the partial pressure of the inert gas, which is generated at the time of occurrence of the change in the internal volume of the sealed space 20, can be limited, and the temperature sensing performance for sensing the temperature of the low pressure medium, which is outputted from the evaporator 6 and is received in the temperature sensitive rod 52*b*, can be appropriately ensured.

Furthermore, in the present embodiment, the depth L of the blind hole 10 is set in such a manner that the position of the bottom surface 10*b* of the blind hole 10 is located within the low pressure refrigerant flow passage range. Therefore, the temperature of the low pressure refrigerant medium, which is outputted from the evaporator 6, can be conducted to the inside of the blind hole 10, in which the external air temperature has the less influence in comparison to the sealed space 20. In this way, the temperature sensing performance for sensing the temperature of the low pressure medium, which is outputted from the evaporator 6 and is received in the temperature sensitive rod 52*b*, can be appropriately ensured.

Furthermore, the expansion valve 5 of the present embodiment is of a type (gas charge type), in which the mixture gas of the refrigerant and the inert gas is sealed into the sealed space 20 without using the adsorbent, such as the activated carbon. Therefore, it is possible to have the MOP (maximum operating pressure) characteristic in the operational temperature range of the expansion valve 5. The MOP characteristic is the characteristic, which results in that the working fluid in the closed space becomes the heated gas, and thereby the pressure increase in the sealed space 20 becomes moderate relative to the temperature increase, so that the drive force of the compressor 2 at the time of high load operation can be reduced.

(Second Embodiment)

Figure 5:
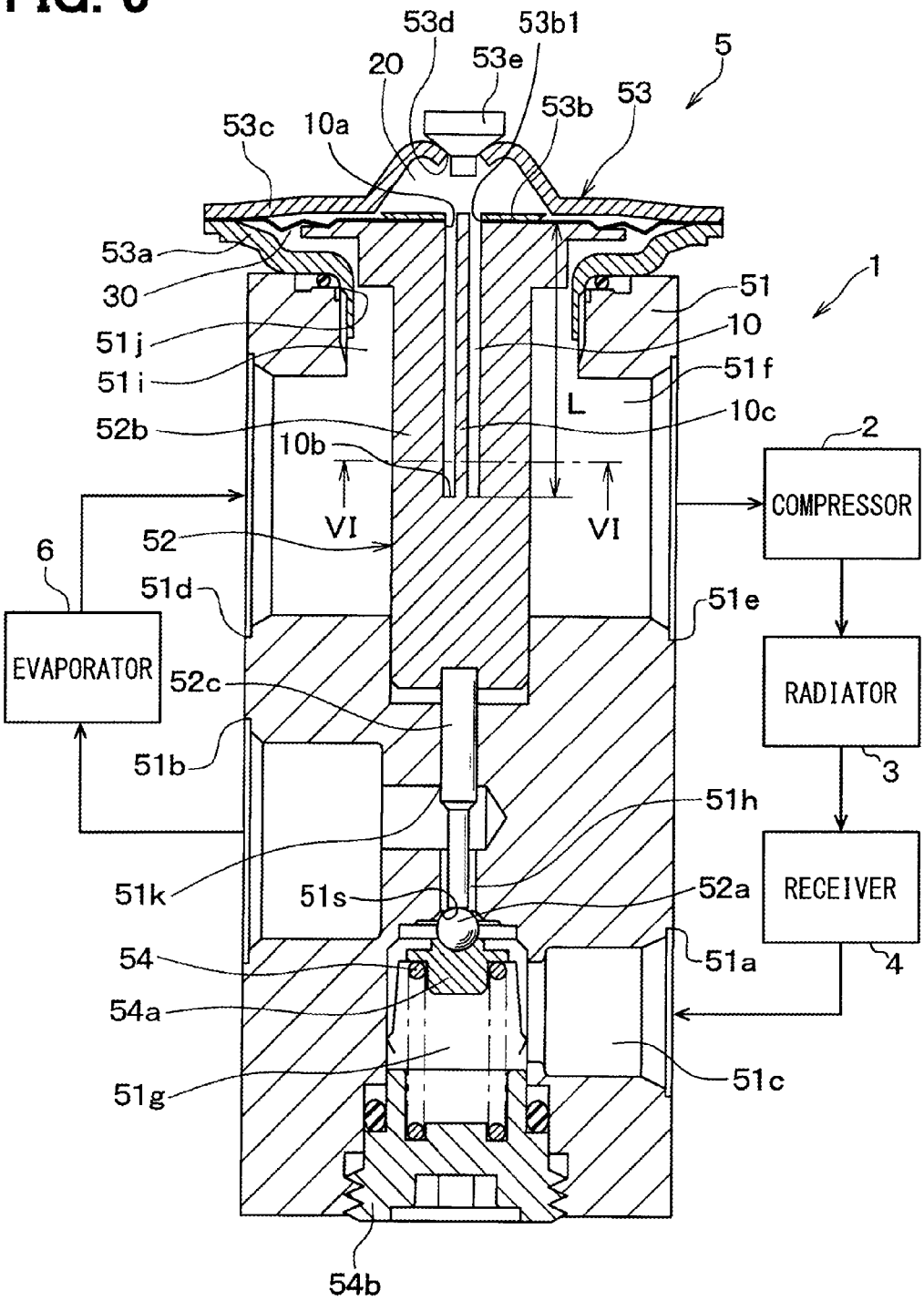
FIG. 5 is a cross-sectional view of an expansion valve according to a second embodiment of the present disclosure.
Figure 6:
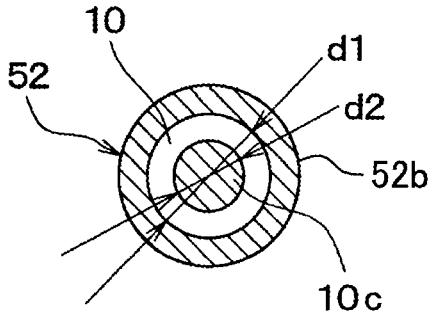
FIG. 6 is a cross sectional view taken along line VI-VI in FIG. 5.

Next, in a second embodiment of the present disclosure, as shown in FIGS. 5 and 6, there will be described an example, in which the blind hole 10 in the inside of the temperature sensitive rod 52*b* of the first embodiment is configured into an annular form. In FIGS. 5 and 6, the components, which are the same as or equivalent to the components of the first embodiment, are indicated by the same reference numerals.

The blind hole 10 of the present embodiment is configured into an annular form by leaving an inner axial bar 10*c*, which extends from the bottom surface 10*b* of the blind hole 10 to the opening 10*a* of the blind hole 10 in the axial direction of the temperature sensitive rod 52*b*, at the central axis position of the temperature sensitive rod 52*b*. A cross section of the inner axial bar 10*c* and the inner and outer wall surfaces of the temperature sensitive rod 52*b* are concentric to each other, as shown in FIG. 6. The inner axial bar 10*c* is a portion, which is left at the time of processing the inside of the temperature sensitive rod 52*b* into an annular form. The material of the inner axial bar 10*c* is the same as that of the temperature sensitive rod 52*b*.

In the present embodiment, the diameter of the inner wall of the temperature sensitive rod 52*b* is indicated by d1, and the diameter of the inner axial bar 10*c* is indicated by d2. In such a case, a hydraulic diameter (=De), which is defined by the following equations F3 to F5, is set as an equivalent diameter De of the blind hole 10 measured in a direction perpendicular to the axis of the blind hole 10.

$$De=(4\times Af)/Lfw \quad \text{(F3)}$$

$$Lfw=\pi\times d1+\pi\times d2 \quad \text{(F4)}$$

$$Af=(\pi\times d1^2)/4+(\pi\times d2^2)/4 \quad \text{(F5)}$$

Here, Lfw indicates a flow passage wet length, and Af indicates a flow passage cross-sectional area.

The expansion valve 5 of the present embodiment tends to exhibit the following characteristics. That is, the time constant τ of the heat conduction from the temperature sensitive rod 52*b* to the temperature sensitive medium tends to be lengthened in proportional to an increase in the ratio α (=L/De) of the equivalent diameter De of the blind hole 10 relative to the depth L of the blind hole 10. Furthermore, a rate of change (gradient) of the time constant τ with respect to the ratio α of the equivalent diameter De of the blind hole 10 relative to the depth L of the blind hole 10 tends to be increased in response to an increase in the mixing ratio β of the inert gas.

Therefore, in the present embodiment, similar to the first embodiment, the inert gas is sealed into the sealed space 20 in such a manner that the mixing ratio β of the inert gas satisfies the relationship indicated by the equations F1, F2 when the time constant τ and the ratio α of the equivalent diameter De relative to the depth L are set.

Even with the structure of the present embodiment, when the mixing ratio β of the inert gas is set according to the ratio α of the equivalent diameter De relative to the depth L of the blind hole 10, the required time constant τ of the heat conduction from the temperature sensitive rod 52*b* to the temperature sensitive medium in the blind hole 10 can be ensured. Thus, the advantages, which are similar to those of the first embodiment can be achieved.

In addition, in the expansion valve 5 of the present embodiment, the blind hole 10 is configured into the annular form. Therefore, the temperature sensitive medium, which is present in the inside of the blind hole 10, can be placed closer to the low pressure refrigerant passage 51*f*. Thus, the temperature of the low pressure refrigerant, which is outputted from the evaporator 6, can be conducted to the temperature sensitive medium in the inside of the blind hole 10, in which the external air temperature has the less influence in comparison to the sealed space 20.

Furthermore, with the structure of placing the inner axial bar 10*c* in the inside of the blind hole 10, a heat capacity (thermal mass) of the inner axial bar 10*c* increases a heat capacity of the inside of the blind hole 10. Therefore, the required time constant τ of the heat conduction to the temperature sensitive medium can be ensured.

(Other Embodiments)

The embodiments of the present disclosure have been described. However, the present disclosure is not limited to these embodiments, and improvements based on the knowledge of a person skilled in the art can be appropriately added as long as such improvements are within the scope of the present disclosure. For example, the above embodiments may be modified as follows.

(1) In the respective embodiments discussed above, the inert gas is sealed into the sealed space 20 in such a manner that the mixing ratio of the inert gas satisfies the relationship indicated by the equations F1, F2 when the time constant $\tau$, which is kept within the predetermined time constant range, and the ratio $\alpha$ of the equivalent diameter D of the blind hole 10 relative to the depth L of the blind hole 10 are set. However, the present disclosure is not limited to this.

For example, a characteristic map, which defines the relationship among the time constant $\tau$, the ratio $\alpha$ of the equivalent diameter D of the blind hole 10 relative to the depth L of the blind hole 10, and the mixing ratio $\beta$ of the inert gas shown in FIG. 3, is prepared. Then, the inert gas is sealed into the sealed space 20 in such a manner that the mixing ratio $\beta$ of the inert gas is the ratio obtained from the characteristic map when the time constant $\tau$, and the ratio $\alpha$ of the equivalent diameter D of the blind hole 10 relative to the depth L of the blind hole 10 are set.

(2) In the respective embodiments discussed above, there is described the example where R134a is used as the refrigerant. However, the present disclosure is not limited to this. That is, the refrigerant, such as R1234yf, R152a, R600a, which is used in the typical refrigeration cycle 1, can be used as the refrigerant of the present disclosure.

(3) As discussed in the respective embodiments, although it is desirable to set the range of the time constant $\tau$ to be equal to or longer than 50 seconds and is equal to or shorter than 150 seconds, the range of the time constant $\tau$ may be set to another range.

(4) As discussed in the above respective embodiments, although it is desirable to set the ratio $\alpha$ of the equivalent diameter D of the blind hole 10 relative to the depth L of the blind hole 10 in the range of $0<\alpha<10$, the ratio $\alpha$ of the equivalent diameter D of the blind hole 10 relative to the depth L of the blind hole 10 may be set in a range of $\alpha<10$.

(5) As discussed in the respective embodiments, it is desirable that the mixing ratio $\beta$ of the inert gas is set in such a manner that the change in the partial pressure of the inert gas at the time of changing the internal volume of the sealed space 20 in response to the displacement of the diaphragm 53*b* is kept in the range that is equal to or less than the reference pressure. Alternatively, the mixing ratio $\beta$ of the inert gas may be set by using the equations F1, F2 or the like.

(6) The expansion valve 5 discussed in the respective embodiments can be applied to the refrigeration cycle 1 of a stationary air conditioning system or of a refrigeration system besides the refrigeration cycle 1 of the vehicle air conditioning system.

What is claimed is:

1. An expansion valve, which is applied to a vapor compression refrigeration cycle, wherein the expansion valve depressurizes and expands a high pressure refrigerant, and the expansion valve outputs a low pressure refrigerant, which is depressurized and expanded by the expansion valve, toward a refrigerant inlet of an evaporator, the expansion valve comprising:

a body portion that forms:

a high pressure refrigerant passage that conducts the high pressure refrigerant;

a throttle passage that is provided in the high pressure refrigerant passage, wherein the throttle passage depressurizes and expands the high pressure refrigerant; and a low pressure refrigerant passage that conducts the low pressure refrigerant, which is outputted from the evaporator;

a valve element that adjusts an opening degree of the throttle passage;

an element portion that is placed outside of the body portion and includes a pressure-operated member, wherein the pressure-operated member is displaceable in response to a pressure difference between:

an internal pressure of a sealed space of the element portion, in which a temperature sensitive medium is sealed, wherein a pressure of the temperature sensitive medium is changeable in response to a temperature; and a pressure of the low pressure refrigerant that flows in the low pressure refrigerant passage; and a temperature sensitive rod that is placed such that at least a portion of the temperature sensitive rod is located in the low pressure refrigerant passage, wherein the temperature sensitive rod conducts displacement of the pressure-operated member to the valve element and conducts a temperature of the low pressure refrigerant, which flows through the low pressure refrigerant passage, to the temperature sensitive medium, wherein:

the temperature sensitive rod includes a blind hole, which opens to the sealed space and extends in an inside of the temperature sensitive rod in an axial direction of the temperature sensitive rod, wherein the blind hole is configured to include an inner axial bar;

the temperature sensitive medium is a mixture gas, which is a mixture of a refrigerant and an inert gas, wherein the inert gas is different from the refrigerant; and a mixing ratio of the inert gas in the temperature sensitive medium is set based on a ratio of an equivalent diameter of the blind hole, which is measured in a direction perpendicular to the axial direction of the temperature sensitive rod, relative to a depth of the blind hole, which is measured in the axial direction of the temperature sensitive rod, in such a manner that a time constant of heat conduction from the temperature sensitive rod to the temperature sensitive medium is kept within a predetermined time constant range.

2. The expansion valve according to claim 1, wherein the ratio of the equivalent diameter of the blind hole relative to the depth of the blind hole is larger than 0 and smaller than 10.

3. The expansion valve according to claim 1, wherein the mixing ratio of the inert gas is set in such a manner that a change in a partial pressure of the inert gas at a time of changing an internal volume of the sealed space in response to displacement of the pressure-operated member is kept in a range that is equal to or less than a predetermined reference pressure difference.

* * * * *